US012735822B2

(12) United States Patent
Mead et al.

(10) Patent No.: US 12,735,822 B2
(45) Date of Patent: Sep. 15, 2026

(54) METHOD AND APPARATUS FOR SURFACE TREATMENT OF NONWOVEN MATERIALS

(71) Applicant: HEMPITECTURE, INC., Ketchum, ID (US)

(72) Inventors: Matthew Mead, Ketchum, ID (US); Thomas Gibbons, Ketchum, ID (US)

(73) Assignee: HEMPITECTURE, INC., Ketchum, ID (US)

( * ) Notice: Subject to any disclaimer, the term of this patent is extended or adjusted under 35 U.S.C. 154(b) by 71 days.

(21) Appl. No.: 18/389,118

(22) Filed: Nov. 13, 2023

(65) Prior Publication Data

US 2024/0158974 A1 May 16, 2024

Related U.S. Application Data

(60) Provisional application No. 63/424,767, filed on Nov. 11, 2022.

(51) Int. Cl.

| | |
|---|---|
| ***D06B 1/02*** | (2006.01) |
| ***D06B 11/00*** | (2006.01) |
| ***D06B 23/20*** | (2006.01) |
| ***D06B 23/24*** | (2006.01) |

(52) U.S. Cl.

CPC ..... *D06B 1/02* (2013.01); *D06B 11/0059* (2013.01); *D06B 23/20* (2013.01); *D06B 23/24* (2013.01)

(58) Field of Classification Search

None

See application file for complete search history.

(56) References Cited

U.S. PATENT DOCUMENTS 4,726,388 A * 2/1988 Swinehart ..... B60S 3/04 134/123

6,000,630 A * 12/1999 Takenawa ..... B05B 9/06 239/566

* cited by examiner

*Primary Examiner* — Alexander M Weddle

(74) *Attorney, Agent, or Firm* — Maschoff Brennan

(57) ABSTRACT

In an embodiment, a surface treatment system to treat a nonwoven material by a chemical emulsion is described. The surface treatment system includes an air compressor to pressurize a tank to deliver the chemical emulsion to one or more spray heads of an emulsion applicator. The surface treatment system further includes the emulsion applicator to treat the nonwoven material by the chemical emulsion. The one or more spray heads are mounted on an adjustable bar of the emulsion applicator, and spray the chemical emulsion on a surface of the nonwoven material. The adjustable bar moves in one or more planes and allows the one or more spray heads to spray the chemical emulsion in a spray pattern of the surface of the nonwoven material.

12 Claims, 6 Drawing Sheets

METHOD AND APPARATUS FOR SURFACE TREATMENT OF NONWOVEN MATERIALS

RELATED APPLICATION(S)

This application claims priority under 35 U.S.C. § 119(e) of the U.S. Provisional Patent Application Ser. No. 63/424,767, filed Nov. 11, 2022, and titled "METHOD AND APPARATUS FOR SURFACE TREATMENT OF NONWOVEN MATERIALS" which is hereby incorporated by reference in its entirety.

FIELD OF THE INVENTION

The embodiments discussed in the present disclosure are generally related to nonwoven materials. In particular, the embodiments discussed are related to providing surface treatment to fibrous nonwoven materials.

BACKGROUND OF THE INVENTION

Nonwoven materials have a wide variety of applications in various industries including construction materials, medical applications, absorbent personal care products, garments, and cleaning applications. For instance, one of the many applications of nonwoven materials is that they are used as building materials, such as thermal and acoustic insulation. Nonwoven materials are made from natural or synthetic fibers bonded together to form planar sheets or panels. These panels can range in density, thickness, material composition, and end use applications. In some cases, nonwoven materials are comprised of natural fibers, including but not limited to hemp, flax, ramie, sisal, cotton, jute, banana, coir, switchgrass, kenaf, kudzu, linden, milkweed, nettle, okra, and paper mulberry, and they may be flammable and susceptible to moisture. Accordingly, these materials need various types of treatment, including in some instances surface treatment, to achieve desired performance attributes towards their intended applications.

Conventionally, nonwoven materials and the natural fibers they are composed of require treatment of the fibers to pass regulatory standards for their acceptable use. This treatment is provided by treating the fibers with solutions that include, but are not limited to, fire retardants, waxes, paraffins, emulsions, organic solutions, and/or inorganic solutions. Generally, this treatment process does not occur within the manufacturing process of the nonwoven material, but rather, rely on pre-treatment techniques before the fibers are converted into their end-use nonwoven application. Once treated, the fibers are required to be dried prior to the formation of a resulting nonwoven material panel. The above-described process requires expensive machinery, energy-intensive drying processes, and the possibility of manufacturing downtime, which further results in undesired cost and time consumption. Further, the pre-treatment of fiber in wet processes results in high water consumption rates, which also results in contaminated water that must be adequately treated to be returned back to municipal water supply.

Therefore, there is a need to overcome the above-described challenges.

SUMMARY OF THE INVENTION

Embodiments of a surface treatment system and a corresponding method are described to overcome the challenges associated with the conventional mechanisms of non pretreatment of natural fibers for nonwoven materials in favor of an in-process, surface treatment process that reduces water consumption and eliminates the challenges described.

In a first aspect, a surface treatment system to treat nonwoven material by a chemical emulsion is described. The surface treatment system includes an air compressor to pressurize a tank to deliver the chemical emulsion to one or more spray heads of an emulsion applicator. The surface treatment system further includes the emulsion applicator to treat the nonwoven material by the chemical emulsion. The one or more spray heads are mounted on an adjustable bar of the emulsion applicator, and spray the chemical emulsion on a surface of the nonwoven material. Further, the adjustable bar moves in one or more planes and allows the one or more spray heads to spray the chemical emulsion in a spray pattern on the surface of the nonwoven material.

In a second aspect, a surface treatment method to treat nonwoven material by a chemical emulsion is described. The surface treatment method includes pressurizing, by an air compressor, a tank to deliver the chemical emulsion to one or more spray heads of an emulsion applicator. The method further includes treating, by the emulsion applicator, the nonwoven material by the chemical emulsion. Treating the nonwoven material includes: spraying, by the one or more spray heads mounted on an adjustable bar of the emulsion applicator, the chemical emulsion on a surface of the nonwoven material; and moving, by the adjustable bar, in one or more planes and allowing the one or more spray heads to spray the chemical emulsion in a spray pattern on the surface of the nonwoven material.

BRIEF DESCRIPTION OF THE DRAWINGS

Further advantages of the invention will become apparent by reference to the detailed description of preferred embodiments when considered in conjunction with the drawings.

DETAILED DESCRIPTION

Figure 1:
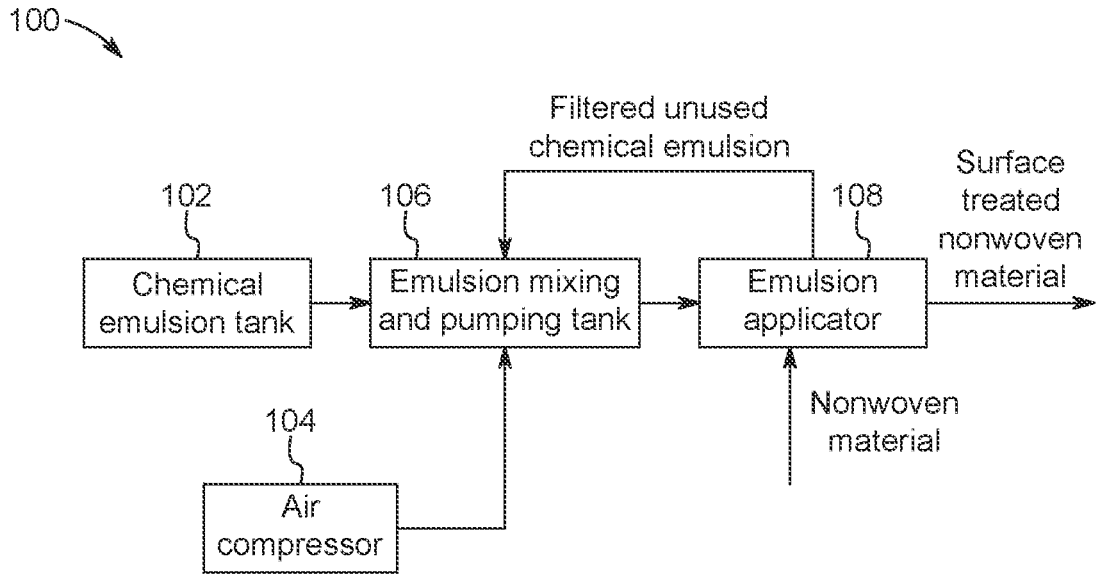
FIG. 1 illustrates the various building blocks of a surface treatment system, according to some embodiments.

The following detailed description is presented to enable any person skilled in the art to make and use the invention. For purposes of explanation, specific details are set forth to provide a thorough understanding of the present invention. However, it will be apparent to one skilled in the art that these specific details are not required to practice the invention. Descriptions of specific applications are provided only as representative examples. Various modifications to the preferred embodiments will be readily apparent to one skilled in the art, and the general principles defined herein may be applied to other embodiments and applications without departing from the scope of the invention. The present invention is not intended to be limited to the embodiments shown but is to be accorded the widest possible scope consistent with the principles and features disclosed herein.

Certain terms and phrases have been used throughout the disclosure and will have the following meanings in the context of the ongoing disclosure.

A "nonwoven material" may refer to innovative, high-tech, engineered fabrics made from fibers. Such fabrics are used in a wide range of consumer and industrial products either in combination with other materials or alone. Nonwoven materials are designed for their specific application, ranging from thin, light weight nonwovens to strong and durable nonwovens, be it consumer or industrial applications. The combination of their specific characteristics through the raw materials selection, the formation and bonding methods used, or the applied finishing treatments, such as printing, embossing, laminating etc., allow them to deliver high-performance products.

"Atomization" may refer to a process by which a liquid solution is sprayed by means of the pressure with which it reaches the dispensing point. Atomization is used for medium-high volume treatments of liquid solutions.

"Nebulization" may refer to a process designed to micronize a liquid solution into very fine parts and are therefore more suitable for low-volume treatments of liquid solutions.

"Thermobonding" may refer to the conglutination of thermoplastic fibers with each other or with other fibers by means of thermoplastics.

"Quick disconnect fittings" may be used to provide fast and easy connection and disconnection of fluid lines. These fittings are also known as quick connects or quick release couplings. Typically, quick disconnect fittings are operated by hand. Often, they are used to replace fitting connections which require tools to assemble and disassemble.

The present disclosure offers a plurality of advantages, some of which are: spraying one or more surfaces of nonwoven materials allows for the application of desired solutions to achieve certain performance characteristics including, but not limited to, minimizing flame spread, increasing waterproofness, or in some cases, even for the purpose of applying adhesives. The proposed surface treatment system is designed to spray in a controlled manner, that is in sequence with other nonwoven machinery components such as conveyors, to spray only when needed. Further, the proposed surface treatment process reduces the use of excess water or the creation of waste water through fiber pretreatment, which is energy intensive and has waste water that may involve special treatment. Surface treatment of the nonwoven materials through using the proposed surface treatment system allows for flexibility in location of spraying a chemical emulsion or a desired solution, such as before a thermobonding process of the nonwoven materials, or at the end of the line as a finishing step in the manufacture of the nonwoven materials.

The embodiments of the methods and systems are described in more detail with reference to FIGS. 1-6.

FIG. 1 illustrates the various building blocks of a surface treatment system 100, in accordance with some embodiments of the present disclosure. In an embodiment, the building blocks of surface treatment system 100 may include, but are not limited to, chemical emulsion tank 102, air compressor 104, emulsion mixing and pumping tank 106, and emulsion applicator 108.

In an embodiment, chemical emulsion tank 102 may store a chemical emulsion that may be used to treat one or more nonwoven materials. In this embodiment and all other embodiments discussed below, a desired solution may be used (to treat the one or more nonwoven materials such that the one or more nonwoven materials achieve desired performance attributes towards their intended applications) instead of the chemical emulsion. The composition of the chemical emulsion may be from a wide range of materials depending at least on desired performance attributes of the one or more nonwoven materials that are to be treated using the chemical emulsion. In an embodiment, the chemical emulsion may include one or more of: chemicals, waxes, paraffins, and adhesives, that may be used to treat the one or more nonwoven materials. Further, in an embodiment, chemical emulsion tank 102 may transfer the chemical emulsion to emulsion mixing and pumping tank 106.

In an embodiment, air compressor 104 of surface treatment system 100 may be connected to emulsion mixing and pumping tank 106 and may pressurize emulsion mixing and pumping tank 106 to deliver the chemical emulsion to one or more spray heads (not shown in FIG. 1) of emulsion applicator 108.

In an embodiment, emulsion mixing and pumping tank 106 may deliver the chemical emulsion to the one or more spray heads of emulsion applicator 108 by using a pump (not shown in FIG. 1) and compressed air obtained from air compressor 104. In an embodiment, the pump of emulsion mixing and pumping tank 106 may be a hydraulic pump.

In an embodiment, the one or more spray heads of emulsion applicator 108 may nebulize or atomize the chemical emulsion to be sprayed on one or more surfaces of a nonwoven material.

In an embodiment, emulsion applicator 108 may adjust pressure of the one or more spray heads to realize one or more of: different spraying patterns of the spray, different coverage ratios of the spray, and at least one predetermined pattern of spray on the one or more surfaces of the nonwoven material. In an embodiment, the pressure may be adjusted to achieve a more concentrated or diluted spray application of the chemical emulsion.

In an embodiment, emulsion applicator 108 may treat the nonwoven material by the chemical emulsion. In an embodiment, emulsion applicator 108 may treat the nonwoven material using the one or more spray heads. In an embodiment, the one or more spray heads may be mounted on at least one adjustable bar (not shown in FIG. 1) of emulsion applicator 108, and may spray the chemical emulsion on the one or more surfaces of the nonwoven material. In an embodiment, the one or more spray heads may spray the chemical emulsion on the one or more surfaces of the nonwoven material only when emulsion applicator 108 receives a first signal indicating movement of the nonwoven material through surface treatment system 100. That is, emulsion applicator 108 may receive the first signal, and the one or more spray heads (included in emulsion applicator 108) may spray the chemical emulsion on the one or more surfaces of the nonwoven material in response to the first signal. In an embodiment, the one or more spray heads may cease to spray the chemical emulsion on the one or more surfaces of the nonwoven material when the first signal is terminated. Further, in an alternative or additional embodiment, during a period of spraying, if emulsion applicator 108 receives a second signal indicating an absence of movement of the nonwoven material through surface treatment system 100 (i.e., indicating that the nonwoven material is no longer conveying through surface treatment system 100), the one or more spray heads may cease spraying the chemical emulsion on the one or more surfaces of the nonwoven material. That is, the one or more spray heads cease spraying the chemical emulsion on the one or more surfaces of the nonwoven material in response to the second signal In an embodiment, the spray heads may be interconnected with one or more flexible tubes and quick fitting connections (in an example, quick disconnect fittings), allowing the chemical emulsion and compressed air mixture to arrive at the one or more spray heads. In an embodiment, the chemical emulsion and compressed air mixture may be a mixture desired by an operator or a functional entity of surface treatment system 100. In an embodiment, the one or more spray heads may spray the chemical emulsion on the one or more surfaces of the nonwoven material before a thermobonding process of the nonwoven material. Further, in an additional or alternative embodiment, the one or more spray heads may spray the chemical emulsion on the one or more surfaces of the nonwoven material at the end of line in the manufacturing process of the nonwoven material.

Further, emulsion applicator 108 may treat the nonwoven material using the at least one adjustable bar. In an embodiment, the at least one adjustable bar may move in one or more planes and allow the one or more spray heads to spray the chemical emulsion in a spray pattern on the one or more surfaces of the nonwoven material. In an embodiment, the at least one adjustable bar may move in the one or more planes and allow the one or more spray heads to spray the chemical emulsion in the spray pattern, based at least on: a treatment requirement of the nonwoven material and one or more dimensions of the nonwoven material. In an embodiment, emulsion applicator 108 may provide an adjustability in a height of the at least one adjustable bar that supports the spray heads. The height may be adjusted depending at least on a thickness of the nonwoven material passing through surface treatment system 100. Further, in an embodiment, air compressor 104 may pressurize emulsion mixing and pumping tank 106 to deliver the chemical emulsion to one or more other spray heads of emulsion applicator 108. The one or more other spray heads may be mounted on at least another adjustable bar of emulsion applicator 108 and may spray the chemical emulsion on another surface of the nonwoven material. Further, in an embodiment, the another adjustable bar may move in the one or more planes and may allow the one or more other spray heads to spray the chemical emulsion in a spray pattern on the another surface of the nonwoven material. In an embodiment, the at least one adjustable bar and the at least another adjustable bar may be configured to work simultaneously.

In an embodiment, a pump of emulsion applicator 108 may collect unused chemical emulsion sprayed from the one or more spray heads to treat the nonwoven material. In an embodiment, the pump of emulsion applicator 108 may collect the unused chemical emulsion sprayed from the one or more spray heads to treat the nonwoven material from a catch pan positioned below emulsion applicator 108. Further, the pump of emulsion applicator 108 may filter the unused chemical emulsion for impurities, and then pump the filtered chemical emulsion to the tank for treating the nonwoven material or one or more other nonwoven materials.

In an embodiment, surface treatment system 100 may further include a support frame (not shown in FIG. 1) mounted to a conveyor (also not shown in FIG. 1) when treating the nonwoven material by the chemical emulsion. In an embodiment, the support frame includes a wall that supports one or more of a horizontal portion of the support frame, and the at least one adjustable bar and the at least another adjustable bar. The support frame may be fabricated from various materials such as one or more metal(s) machined to provide structural support for elements of surface treatment system 100 such as the adjustable bars. Further, one of the functions of the support frame may be to allow the adjustability of the elements (of surface treatment system 100), as well as allow the spraying elements (the spray head(s) and adjustable bar(s)) to structurally stand alone, or alternatively, to be integrated into one or more components of the production process of nonwoven materials, such as on conveyance components. In an alternative embodiment, surface treatment system 100 may operate independent of at least a conveyor when treating the nonwoven material by the chemical emulsion.

In an embodiment, surface treatment system 100 may be composed of one or more pneumatic, mechanical, electrical, and plumbing components, other than those discussed above, and that are known in the art, such that the configuration in which they are arranged allows free flowing solutions such as chemicals, waxes, paraffins, etc., to be spray applied to one or more surfaces of nonwoven materials.

Figure 2:
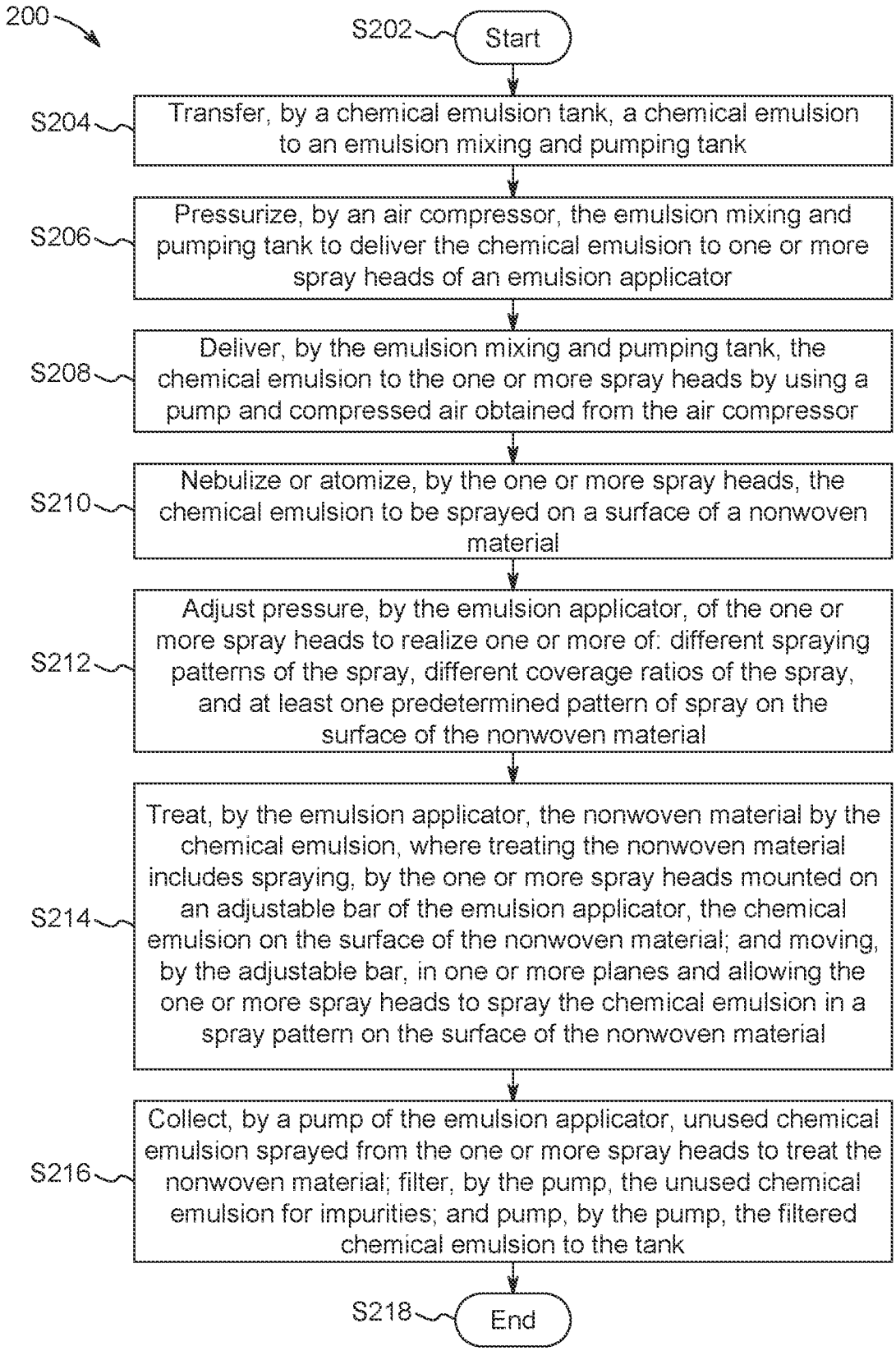
FIG. 2 illustrates a flowchart of a surface treatment process, according to some embodiments.

FIG. 2 illustrates a flowchart of a surface treatment method 200 performed by surface treatment system 100 of FIG. 1, in accordance with some embodiments of the present disclosure. In an embodiment, one or more steps of method 200 may be performed by one or more entities included in surface treatment system 100.

The method 200 starts with step S202. Then, at step S204, chemical emulsion tank 102 may transfer a chemical emulsion to emulsion mixing and pumping tank 106. In the next step, i.e., at step S206, air compressor 104 may pressurize emulsion mixing and pumping tank 106 to deliver the chemical emulsion to one or more spray heads of emulsion applicator 108. Subsequently, at step S208, emulsion mixing and pumping tank 106 may deliver the chemical emulsion to the one or more spray heads by using a pump and compressed air obtained from air compressor 104.

Then, at step S210, the one or more spray heads may nebulize or atomize the chemical emulsion to be sprayed on a surface of a nonwoven material. At step S212, emulsion applicator 108 may adjust pressure of the one or more spray heads to realize one or more of: different spraying patterns of the spray, different coverage ratios of the spray, and at least one predetermined pattern of spray on the surface of the nonwoven material.

Next, at step S214, emulsion applicator 108 may treat the nonwoven material by the chemical emulsion. In an embodiment, treating the nonwoven material may include spraying, by the one or more spray heads mounted on an adjustable bar of emulsion applicator 108, the chemical emulsion on the surface of the nonwoven material; and moving, by the adjustable bar, in one or more planes and allowing the one or more spray heads to spray the chemical emulsion in a spray pattern on the surface of the nonwoven material. Subsequently, a pump of emulsion applicator 108, in step S216, may collect unused chemical emulsion sprayed from the one or more spray heads to treat the nonwoven material; filter the unused chemical emulsion for impurities; and pump the filtered chemical emulsion to the tank for treating the nonwoven material and/or one or more other nonwoven materials. Further, the method 200 ends with step S218.

Figure 3:
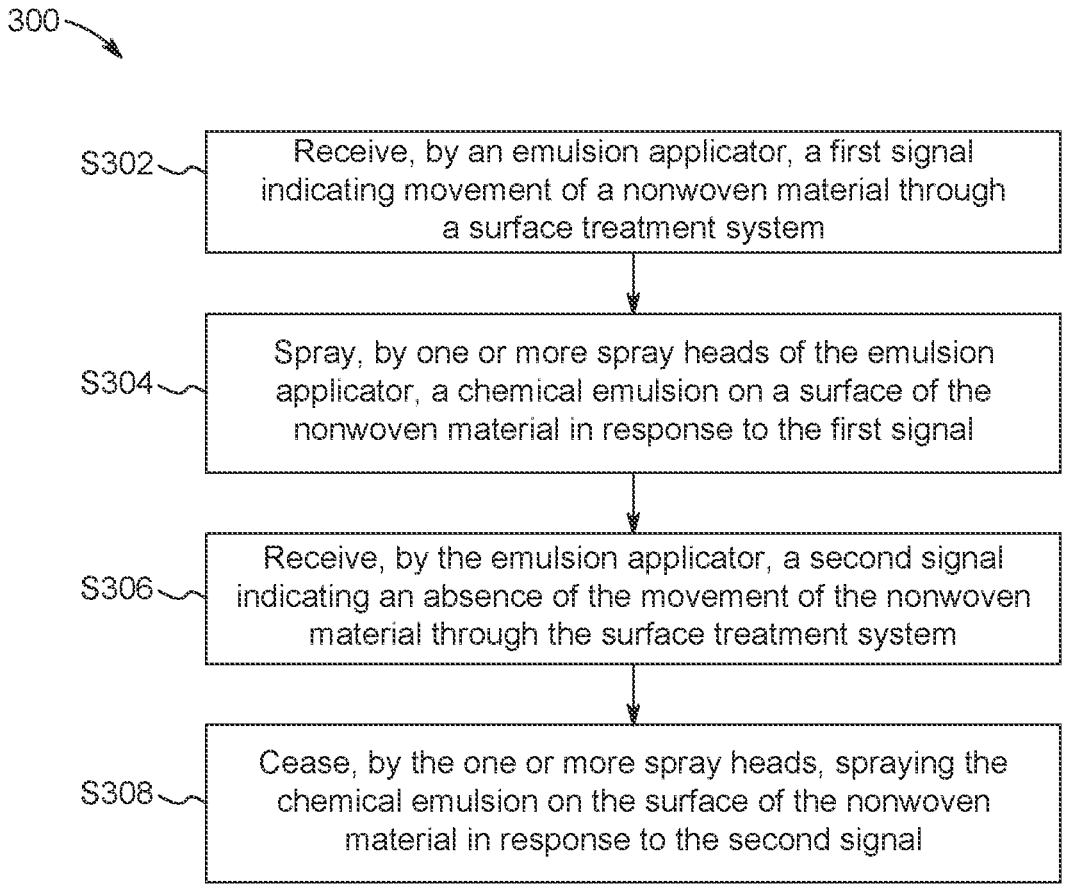
FIG. 3 illustrates a flowchart of a surface treatment method, according to some embodiments.

FIG. 3 illustrates a flowchart of a surface treatment method 300 performed by surface treatment system 100 of FIG. 1, in accordance with some embodiments of the present disclosure. In an embodiment, one or more steps of method 300 may be performed by one or more entities included in the surface treatment system 100. In some embodiments, method 300 may be a part of method 200. In an example of such embodiments, one or more steps of method 300 may be performed after step S212 and before step S216, and as a part of step S214. However, in one or more other examples of such embodiments, the one or more steps of method 300 may be performed anywhere after step S202 and before step S218 with or without a particular sequence.

The method 300 starts with step S302. In step S302, emulsion applicator 108 may receive a first signal indicating movement of a nonwoven material through surface treatment system 100. Then, at step S304, the one or more spray heads of emulsion applicator 108 may spray a chemical emulsion on a surface of the nonwoven material in response to the first signal. In the next step, i.e., at step S306, emulsion applicator 108 may receive a second signal indicating an absence of the movement of the nonwoven material through surface treatment system 100. Alternatively, in step S306, emulsion applicator 108 may detect termination of the first signal indicating the movement of the nonwoven material through surface treatment system 100. Subsequently, at step S308, the one or more spray heads may cease spraying the chemical emulsion on the surface of the nonwoven material in response to the second signal or in response to the detection of the termination of the first signal.

Figure 4:
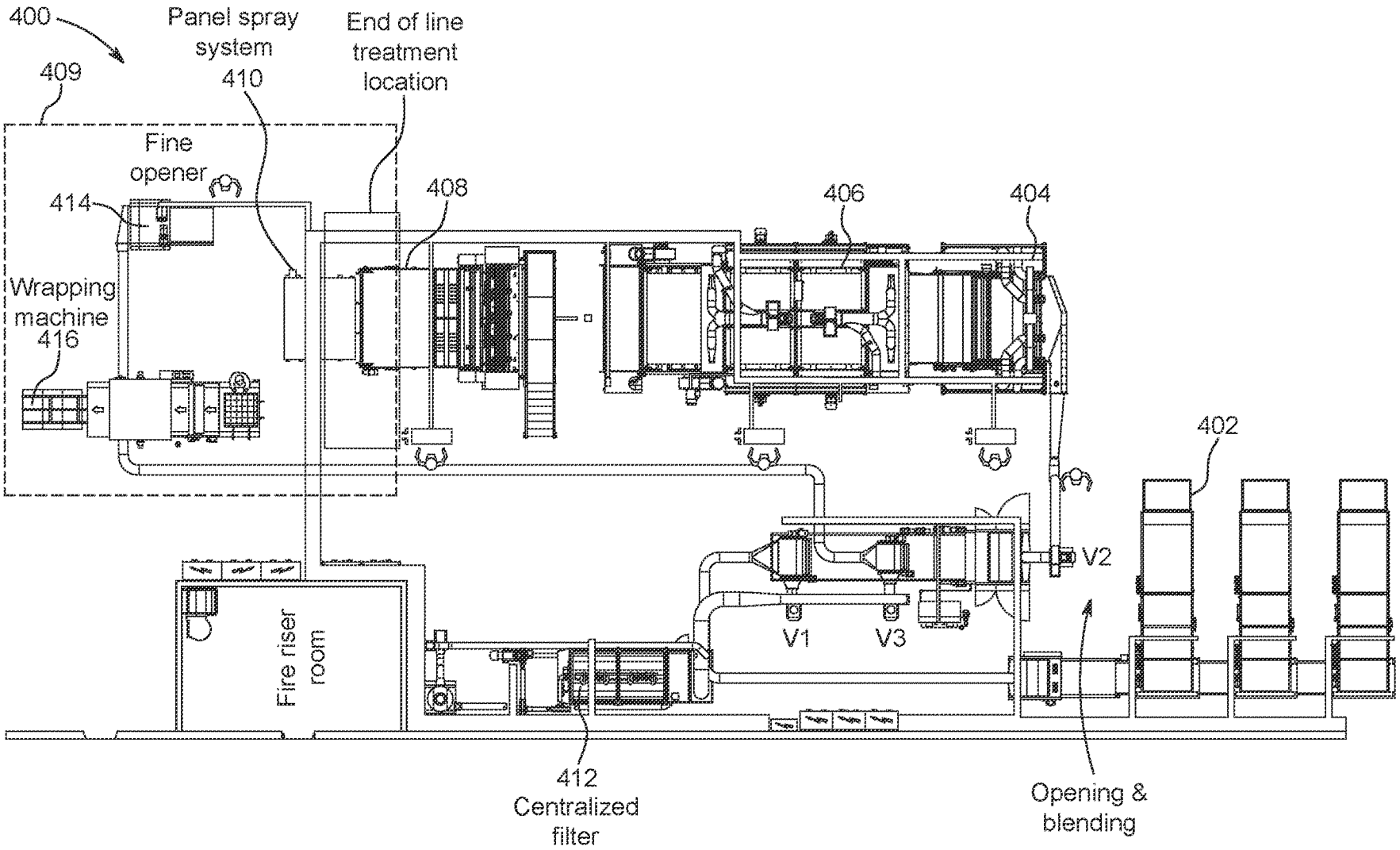
FIG. 4 illustrates an end-of-line treatment location in a manufacturing facility for manufacturing nonwoven materials, according to some embodiments.

FIG. 4 illustrates a top view of a manufacturing facility 400 for manufacturing nonwoven materials (e.g., nonwoven material panels, sheets, or mats), in accordance with some embodiments of the present disclosure. Manufacturing facility 400 illustrated herein may include various components of the manufacturing process of nonwoven materials, such as, but not limited to, an opening and blending section 402, an airlay section 404, a thermobonding oven 406, a cutting unit 408, and a surface treatment system 409 that may include a spray system 410, a centralized filter 412, a recycling opener 414, and a wrapping machine 416. In an embodiment, spray system 410 may include one or more entities (chemical emulsion tank 102, air compressor 104, emulsion mixing and pumping tank 106, and emulsion applicator 108) as discussed in FIG. 1.

In an embodiment, opening and blending section 402 may receive several fibers and blend them together for subsequent processing. This process may open compressed bales of natural and synthetic fibers, thereby separating the fibers and reducing tangles and incohesive groupings of fibers through a series of combing of the fibers. The input may be compressed bales of fiber and the output may be a fiber that is ready for the next step of airlaying, bringing fibers to contain characteristics more suitable for the subsequent steps. Additionally, opening and blending section 402 may mix the variety of fibers, including a low melt bonding fiber.

Further, in an embodiment, airlay section 404 may use propelled air and suction to create a fibrous web that forms a mat of varying thicknesses and densities. The randomized fiber matrix may result in a homogenous fibrous mat that has polymer fibers interspersed throughout the mat. In an embodiment, thermobonding oven 406 may utilize gas burners to ignite and burn natural gas at a desired temperature that is specified to lightly melt the polymer fibers, creating interstitial bonding between the natural fibers and the polymer bonding fibers. Further, thermobonding oven 406 may recirculate heated air and use fans as well as suction to create desired properties depending on the end use application.

In an embodiment, cutting unit 408 may use a series of circular blades and a guillotine blade powered by motor drives and compressed air that cut the nonwoven mat to desired widths and lengths.

Further, in an embodiment, surface treatment system 409 may include spray system 410 that may be a custom designed apparatus (including one or more entities (102, 104, 106, and 108) as described by means of FIG. 1) designed for the purpose of spray applying a chemical emulsion or a desired solution to one or more surfaces of nonwoven materials (including the nonwoven mat). The functionality of the custom designed apparatus (of spray system 410) is described in more detail in the context of FIGS. 1-3.

In an embodiment, centralized filter 412 is a filter system that may capture dusty and contaminated air from the nonwoven material formation process (including nonwoven fibrous mat formation process), resulting in dust mitigation and usable fiber recapture. Further, in an embodiment, recycling opener 414 may include a series of drums, lickerins, and fiber opening devices to recycle edge trim of the nonwoven mat produced in the cutting process, for complete recycling of fibers to the beginning of the process at opening and blending section 402. Additionally, in an embodiment, wrapping machine 116 may be a machine that applies a thermopliable film around bundles of nonwoven mats for the purpose of packaging the mats for palletization.

In an embodiment, a nonwoven material panel manufactured from manufacturing facility 400, may be in the form of a flexible planar sheet that is made from several bonded fibers. The nonwoven material panel may include a top surface and a bottom surface, in accordance with some embodiments of the present disclosure.

Figure 5:
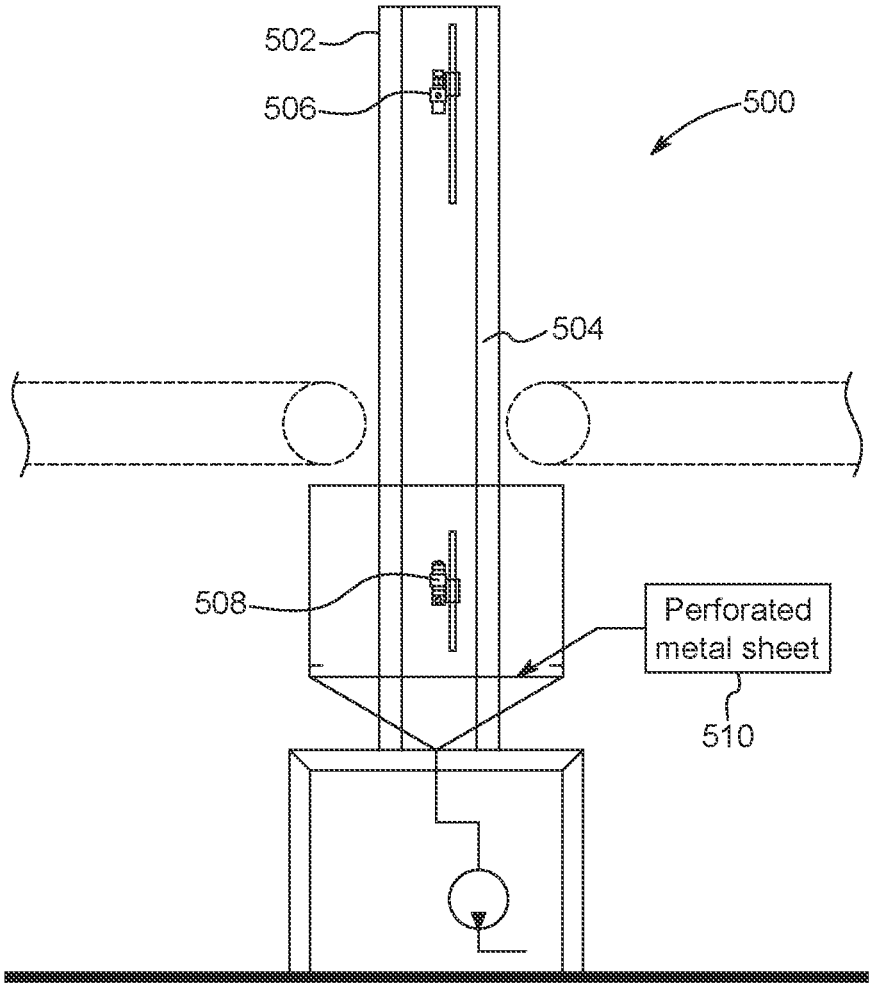
FIG. 5 illustrates a side view of a surface treatment system, according to some embodiments.

FIG. 5 illustrates a line diagram of a side view of a surface treatment system 500, in accordance with some embodiments of the present disclosure. In an embodiment, surface treatment system 500 may include a spray system 502 (in an example, an end-of-line atomized spray system) installed in a nonwoven material manufacturing facility (in an example, manufacturing facility 400, as described in the context of FIG. 4). In an embodiment, surface treatment may be applied by surface treatment system 500 as a final step in the manufacturing process of nonwoven materials to treat one or more surfaces of the nonwoven materials. Alternatively, surface treatment system 500 (implementing the process of surface treatment of the nonwoven materials) may be positioned at one or more different locations in a nonwoven material manufacturing facility (in an example, manufacturing facility 400), such as before a thermobonding oven (in an example, thermobonding oven 406). An advantage of performing the surface treatment before the thermobonding process is that the sprayed chemical emulsion (or the sprayed desired solution) may be cured by the thermobonding oven, reducing the need for additional steps of drying that may be necessary at the end of the manufacturing process of nonwoven materials. Further, performing the surface treatment before the thermobonding process allows for higher concentrations of chemical application in this location (i.e., before the thermobonding oven) than those required at the final step in the manufacturing process of nonwoven materials. Surface treatment system 500 may perform equivalent functions as surface treatment system 409 illustrated in FIG. 4.

In an embodiment, the nonwoven materials may have been produced in manufacturing facility 400 illustrated in FIG. 4 by using processes such as, but not limited to, an airlaid process, a carding process, a spun lace process, a wet laid process, and other known nonwoven fiber intertangling means using one or more of, but not limited to, chemical bonding, thermal bonding, or mechanical bonding (in an example, needle punch technique).

In an embodiment, surface treatment system 500 may include an air compressor (not shown) that may pressurize an emulsion mixing and pumping tank (not shown). The emulsion mixing and pumping tank may include a desired blend of a liquid solution (i.e., a desired solution) to be sprayed on the nonwoven material. The pressurized emulsion mixing and pumping tank may pump the desired solution to one or more spray heads 502 designed for the purpose of spraying both sides of the nonwoven material, either simultaneously or sequentially. Both air pressure and water pressure may be controlled through surface treatment system 500 to apply a desired amount of solution on the nonwoven material. In an embodiment, the desired solution may comprise one of or a combination of, but not limited to, fire retardants, waxes, paraffins, organic solution coatings, and inorganic solution coatings that may be sprayed on the surface of a nonwoven material.

In an embodiment, the solution may further be modified by mixing a corrosion inhibitor in the solution to mitigate any corrosive effects of the solution on the one or more surfaces of the nonwoven materials. In one example, the addition of the corrosion inhibitor may reduce the corrosive effects of the solution such that it is even less corrosive than water.

In an embodiment, spray system 502 may implement a nebulized spray mechanism or an atomized spray mechanism, and may be divided into two halves. Each half of spray system 502 may include a steel tubing 504 connected to one or more spraying heads of spray system 502, which may apply the pressurized solution via a spray application to the surface(s) of the nonwoven material. In an embodiment, spray system 502 may spray the solution on the surface(s) of a finished panel of a nonwoven material.

In an embodiment, spray system 502 may be composed of a top spraying bar 508 (which is adjustable) with 6 special nebulizing spray heads, and a bottom spraying bar 510 (which is also adjustable) with 6 special nebulizing spray heads. A person skilled in the art would understand, however, that the number of spray heads in either of the spraying bars (is adjustable), and is not limited to the specified example and may vary according to various design considerations.

Both top spraying bar 508 and bottom spraying bar 510 may be installed on a frame support including a pump (with a drip tray) for accumulating any excess liquid remnant after spraying the desired solution over nonwoven material panels. Two spraying bars 508, 510 may be adjustable in distance from the surface(s) of the nonwoven material panels. The purpose of the adjustment of spraying bars 508, 510 is to accommodate nonwoven materials (including nonwoven mats) of different depths, as well as to accommodate different coverage ratios. The closer the spraying bars are to the surface of the nonwoven material panels, the more condensed the liquid application will be, whereas vice versa, the further away the spraying bars are from the surface of the nonwoven material panels, the more diffused the application of the liquid will be. The spraying bar adjustment may be through a mechanical means, whether it is manually adjusted via a series of bolts, washers, and screws, and/or pneumatically with air pressure as a means to adjust the working height of the spraying bar.

In an embodiment, spray system 502 may also include an impurity filter (not shown) to filter out any impurities in any excess liquid left over from the sprays and the pump (with the drip tray) is used to recirculate the excess liquid back into the emulsion mixing and pumping tank.

In an embodiment, a nonwoven material panel, when received by spray system 502, may move through spray system 502 on a conveyor belt. During this movement, top spraying bar 508 may spray the desired solution on the top surface of the nonwoven material panel by using its corresponding nebulizing spray heads. Similarly, bottom spraying bar 510 may spray the desired solution on the bottom surface of the nonwoven material panel using its corresponding nebulizing spray heads.

Each spray head in the top and bottom spraying bars may be configured to spray the desired solution on a predefined area of the surface nonwoven material panel such that a spraying bar is able to spray the desired solution on the entire surface area of the nonwoven material panel.

In an embodiment, each spraying bar may be configured to move vertically along steel tubing 504 depending on a thickness of the nonwoven material panel on which the desired solution needs to be sprayed. For instance, for a thicker nonwoven material panel, top spraying bar 508 may be required to be moved upwards and bottom spraying bar 510 may be required to be moved downwards for an efficient spraying mechanism.

Spray system 502 may additionally include a pump (with a drip tray) to collect any waste generated from spray system 502. In one example, the waste may include any excess liquid remnant from the desired solution that is sprayed on the nonwoven material panel. The pump may supply the collected excess liquid to the emulsion mixing and pumping tank, which may further reuse the liquid for further sprays on nonwoven material panels. The pump may passively collect excess liquid from the spray application process, and the excess liquid may be recirculated back to the emulsion mixing and pumping tank, after passing through a filter (that may be included in the pump) that will remove any impurities collected from the process of spraying the nonwoven material panel, including but not limited to dust, fibers, and metals. This process may minimize wastage from the spray mechanism.

Figure 6:
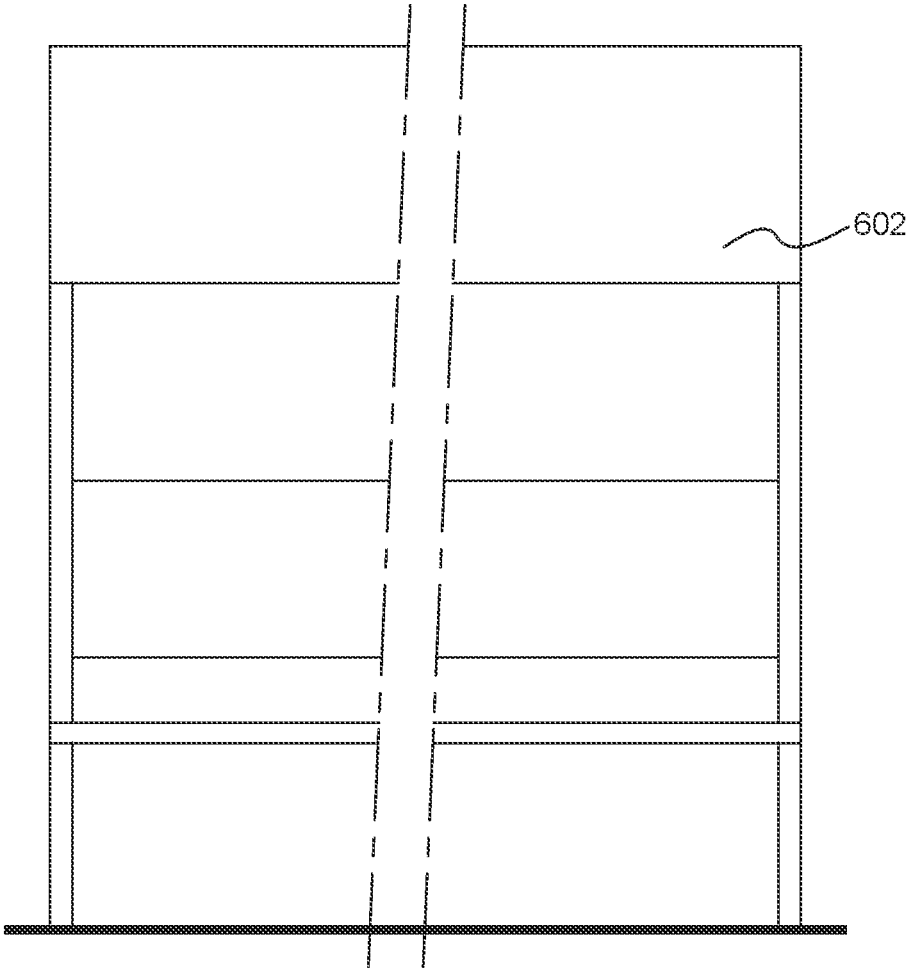
FIG. 6 illustrates an elevation view of a surface treatment system, according to some embodiments.

FIG. 6 illustrates an elevation view of surface treatment system 500, in accordance with some embodiments of the present disclosure. The surface treatment system may be enclosed in a housing 602. Housing 602 may enclose the internal components of surface treatment system 500 described in the context of FIG. 5. The functioning of the surface treatment system illustrated in FIG. 6 is similar to the functioning described in the context of FIG. 5.

Additionally, the surface treatment system described throughout the present disclosure may be self-supported, or designed to adapt into existing our purpose-built machinery, such as conveyance devices. However, the surface treatment system may also exist as a standalone unit with its own support system, allowing it to be moved from the production process, or placed anywhere else within the production process, such as in between different machinery components of FIG. 4.

The embodiments presented herein allow the nonwoven materials to achieve performance attributes required for adoption of these materials in construction of infrastructure (e.g., buildings). In one example, these performance attributes may include one or more of, but not limited to, fire resistance, mold resistance, fungus resistance, and moisture intrusion. The nonwoven materials treated by the techniques presented herein may be used for thermal insulation produced for infrastructure construction, in accordance with, but not limited to, 'Standard Test Method for Surface Burning Characteristics of Building Materials' (ASTM e84) and 'International Code Council Evaluation Service' (ICC-ES) standards.

The illustrated embodiments also prevent cost and time intensive pre-treatment of fibers (e.g., hemp or polyester fibers) used in the manufacturing of nonwoven materials.

This time and energy saving solution allows greater flexibility in formulations that can be applied to fibrous nonwoven materials.

In an embodiment, one or more computer-readable storage media may be utilized in implementing embodiments consistent with the present disclosure. A computer-readable storage medium refers to any type of physical memory on which information or data readable by a processor may be stored. Thus, a computer-readable storage medium may store instructions for execution by one or more processors, including instructions for causing the processor(s) to perform steps or stages consistent with the embodiments described herein. The term "computer-readable medium" should be understood to include tangible items and exclude carrier waves and transient signals, i.e., be non-transitory. Examples include random access memory (RAM), read-only memory (ROM), volatile memory, nonvolatile memory, hard drives, CD ROMs, DVDs, flash drives, disks, and any other known physical storage media.

The terms "comprising," "including," and "having," as used in the claim and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition, or step being referred to is an optional (not required) feature of the invention.

The invention has been described with reference to various specific and preferred embodiments and techniques. However, it should be understood that many variations and modifications may be made while remaining within the spirit and scope of the invention. It will be apparent to one of ordinary skill in the art that methods, devices, device elements, materials, procedures, and techniques other than those specifically described herein can be applied to the practice of the invention as broadly disclosed herein without resort to undue experimentation. All art-known functional equivalents of methods, devices, device elements, materials, procedures, and techniques described herein are intended to be encompassed by this invention. Whenever a range is disclosed, all subranges and individual values are intended to be encompassed. This invention is not to be limited by the embodiments disclosed, including any shown in the drawings or exemplified in the specification, which are given by way of example and not of limitation. Additionally, it should be understood that the various embodiments of the networks, devices, and/or modules described herein contain optional features that can be individually or together applied to any other embodiment shown or contemplated here to be mixed and matched with the features of such networks, devices, and/or modules.

While the invention has been described with respect to a limited number of embodiments, those skilled in the art, having benefit of this disclosure, will appreciate that other embodiments can be devised which do not depart from the scope of the invention as disclosed herein.

We claim:

1. A surface treatment system to treat a nonwoven material by a chemical emulsion, the surface treatment system comprising:

an air compressor configured to pressurize a tank to deliver the chemical emulsion to one or more spray heads of an emulsion applicator; and the emulsion applicator configured to treat the nonwoven material by the chemical emulsion, wherein the one or more spray heads are mounted on an adjustable bar of the emulsion applicator and are configured to spray the chemical emulsion on a surface of the nonwoven material, wherein the one or more spray heads are configured to nebulize the chemical emulsion to be sprayed on the surface of the nonwoven material, wherein the adjustable bar is configured to move in one or more planes and allow the one or more spray heads to spray the chemical emulsion in a spray pattern on the surface of the nonwoven material.

2. The surface treatment system of claim 1, wherein the tank is configured to deliver the chemical emulsion to the one or more spray heads by using a pump and compressed air obtained from the air compressor.

3. The surface treatment system of claim 1, wherein the emulsion applicator is further configured to receive a first signal indicating movement of the nonwoven material through the surface treatment system, and wherein the one or more spray heads are configured to spray the chemical emulsion on the surface of the nonwoven material in response to the first signal.

4. The surface treatment system of claim 3, wherein the emulsion applicator is further configured to receive a second signal indicating an absence of movement of the nonwoven material through the surface treatment system, and wherein the one or more spray heads are configured to cease spraying the chemical emulsion on the surface of the nonwoven material in response to the second signal.

5. The surface treatment system of claim 1, wherein the adjustable bar is configured to move in the one or more planes and allow the one or more spray heads to spray the chemical emulsion in the spray pattern, based at least on: a treatment requirement of the nonwoven material and one or more dimensions of the nonwoven material.

6. The surface treatment system of claim 1, wherein the emulsion applicator further comprises a pump, and wherein the pump is configured to:

collect unused chemical emulsion sprayed from the one or more spray heads to treat the nonwoven material;

filter the unused chemical emulsion for impurities; and pump the filtered chemical emulsion to the tank.

7. The surface treatment system of claim 1, wherein the air compressor is further configured to pressurize the tank to deliver the chemical emulsion to one or more other spray heads of the emulsion applicator, wherein the one or more other spray heads are mounted on another adjustable bar of the emulsion applicator and are configured to spray the chemical emulsion on another surface of the nonwoven material, wherein the another adjustable bar is configured to move in the one or more planes and allow the one or more other spray heads to spray the chemical emulsion in a spray pattern on the another surface of the nonwoven material, and wherein the adjustable bar and the another adjustable bar are configured to work simultaneously.

8. The surface treatment system of claim 1, wherein the surface treatment system further comprises a support frame mounted to a conveyor, wherein the support frame includes a wall supporting the adjustable bar.

9. The surface treatment system of claim 1, wherein the spray heads are interconnected with one or more flexible tubes, allowing the chemical emulsion and compressed air mixture in the one or more spray heads.

10. The surface treatment system of claim 1, wherein the emulsion applicator is further configured to adjust pressure of the one or more spray heads to realize one or more of: different spraying patterns of the spray, different coverage ratios of the spray, and at least one predetermined pattern of spray on the surface of the nonwoven material.

11. The surface treatment system of claim 1, wherein the one or more spray heads are configured to spray the chemical emulsion on the surface of the nonwoven material before a thermobonding process of the nonwoven material.

12. The surface treatment system of claim 1, wherein the one or more spray heads are configured to spray the chemical emulsion on the surface of the nonwoven material at an end of line in a manufacturing process of the nonwoven material.

* * * * *